US012497777B1

(12) United States Patent
Walker

(10) Patent No.: US 12,497,777 B1
(45) Date of Patent: Dec. 16, 2025

(54) MATCHING COPING SYSTEM FOR BUILDING PANELS

(71) Applicant: CARLISLE CONSTRUCTION MATERIALS, LLC, Carlisle, PA (US)

(72) Inventor: Sean Walker, Danville, IN (US)

(73) Assignee: CARLISLE CONSTRUCTION MATERIALS, LLC, Carlisle, PA (US)

( * ) Notice: Subject to any disclaimer, the term of this patent is extended or adjusted under 35 U.S.C. 154(b) by 176 days.

(21) Appl. No.: 18/429,519

(22) Filed: Feb. 1, 2024

(51) Int. Cl.
*E04D 3/40* (2006.01)

(52) U.S. Cl.
CPC ..... *E04D 3/405* (2013.01)

(58) Field of Classification Search
CPC ..... E04D 3/405
USPC ..... 52/3, 60, 300
See application file for complete search history.

(56) References Cited

U.S. PATENT DOCUMENTS 3,862,531 A * 1/1975 Attaway ..... E04D 3/405 52/58
6,216,408 B1 * 4/2001 Davidson ..... E04D 3/405 52/60
6,922,951 B1 * 8/2005 Inzeo ..... E04D 13/15 52/60
7,451,572 B1 * 11/2008 Inzeo ..... E04D 3/405 52/60
8,001,739 B1 8/2011 Inzeo et al.
8,978,317 B1 3/2015 Inzeo
2002/0083666 A1 * 7/2002 Webb ..... E04F 19/02 52/60
2003/0051428 A1 * 3/2003 Kay ..... E04D 3/405 52/566
2005/0235578 A1 * 10/2005 Heidler, Jr. ..... E04D 3/405 52/58
2005/0257443 A1 * 11/2005 Lin ..... E04D 13/15 52/97

* cited by examiner

*Primary Examiner* — Patrick J Maestri
(74) *Attorney, Agent, or Firm* — David R. Heckadon; Gordon Rees Scully Mansukhani LLP

(57) ABSTRACT

A matching coping system for building panels preferably includes a plurality of coping covers, a plurality of coping splices and a plurality of spring support clips. Each coping cover preferably includes a top member, a first side member, a second side member, a first hook member and a second hook member. Each coping splice preferably includes a first splice section and a second splice section. An offset portion extends from one end of each coping splice section. The offset portions of the first and second coping splice sections are attached to each other to form a panel channel. Each spring support clip preferably includes a base portion and a plurality of spring clips. The plurality of spring support clips are attached to a top of a wall. The plurality of coping splices are placed on the spring support clips. The coping covers are snapped over the coping splices.

16 Claims, 7 Drawing Sheets

MATCHING COPING SYSTEM FOR BUILDING PANELS

BACKGROUND OF THE INVENTION

1. Field of the Invention

The present invention relates generally to building construction and more specifically, a matching coping system for building panels, which includes a spacing channel to cosmetically complement the spacing of the building panels.

2. Discussion of the Prior Art

Building panels, such as those manufactured by Citadel Architectural Products, LLC of Greenfield, Indiana are frequently used to cover an exterior wall of a building. It is more aesthetically pleasing to terminate a top of a plurality composite building panels with a coping having a plurality of panel channels, which match a spacing between a plurality of building panels. U.S. Pat. No. 8,001,739 to Inzeo et al. discloses a parapet wall cover system. U.S. Pat. No. 8,978,317 to Inzeo discloses a coping for attachment to a wall with a non-structural exterior building facade. However, it appears that the prior art does not teach or suggest a matching coping system for building panels.

Accordingly, there is a clearly felt need in the art for a matching coping system for building panels, which includes a plurality of coping splices with a spacing channel to cosmetically complement a spacing between adjacent building panels.

SUMMARY OF THE INVENTION

The present invention provides a matching coping system for building panels, which includes a spacing channel to cosmetically complement the spacing of the building panels. The matching coping system for building panels (panel coping system) preferably includes a plurality of coping covers, a plurality of coping splices and a plurality of spring support clips. Each coping cover preferably includes a top member, a first side member, a second side member, a first hook member and a second hook member. The first side member extends downward from a first end of the top member and the second side member extends downward from a second end of the top member. A bottom of the first side member is terminated with the first hook member. A bottom of the second side member is terminated with the second hook.

Each coping splice preferably includes a first splice section and a second splice section. The first splice section is preferably the same as the second splice section. Each splice section includes a top coping member, a first coping side member and a second coping side member. The first coping side member extends downward from a first end of the top coping member. The second coping side member extends downward from a second end of the top coping member. A top offset portion extends from one end of the top coping member. A first offset portion extends from one end of the first coping member. A second offset portion extends from one end of the second coping member. Each offset portion includes an end portion and a flange portion. The end portion extends downward from an end of the coping member. The flange portion extends outward from a bottom of the end portion. The first splice section is assembled to the second splice section by applying a bonding substance to an outer surface area of the first flange portions of the first splice section; applying a bonding substance to an inner surface of the second flange portions of the second splice section; and inserting the first flange portions of the first splice section into the second flange portions of the second splice section. The first and second offset portions form a panel channel. A width of the panel channel is the same as a spacing between two adjacent building panels.

Each spring support clip preferably includes a base portion and a plurality of spring clips. The base portion may be fabricated from a single piece of material or multiple pieces of material. The base portion preferably includes a top clip member, a first clip side member, a second clip side member, a first flange member, a second flange member, a first retention clip and a second retention clip. The first clip side member extends downward from a first end of the top clip member and the second clip side member extends downward from a second end of the top clip member. A first support projection preferably extends outward from the first clip side member to support the first side member of the coping cover. A second support projection preferably extends outward from the second clip side member to support the second side member of the coping cover. The first flange member extends outward from a bottom of the first clip side member. The second flange member extends outward from a bottom of the second clip side member. An end of the first flange member is terminated with the first retention clip. An end of the second flange member is terminated with the second retention clip.

The panel coping system is preferably assembled in the following manner. A plurality spring support clips are attached to the top of a parapet or building wall with fasteners or the like. At least one spring support clip must be located, such that thereof is close to, or over a spacing between two adjacent building panels. The plurality of coping splices are placed on at least one spring support clip, such that the panel channel aligns with the spacing between the two adjacent building panels. The coping cover includes a length, which is the same as the width of a building panel. One end of the coping cover is snapped over a first coping splice and a first spring support clip, and an opposing end of the coping cover is snapped over a second coping splice and a second spring support clip.

Accordingly, it is an object of the present invention to provide a matching coping system for building panels, which includes a plurality of coping splices with a spacing channel to cosmetically complement a spacing between adjacent building panels.

These and additional objects, advantages, features and benefits of the present invention will become apparent from the following specification.

DETAILED DESCRIPTION OF THE PREFERRED EMBODIMENTS

Figure 1:
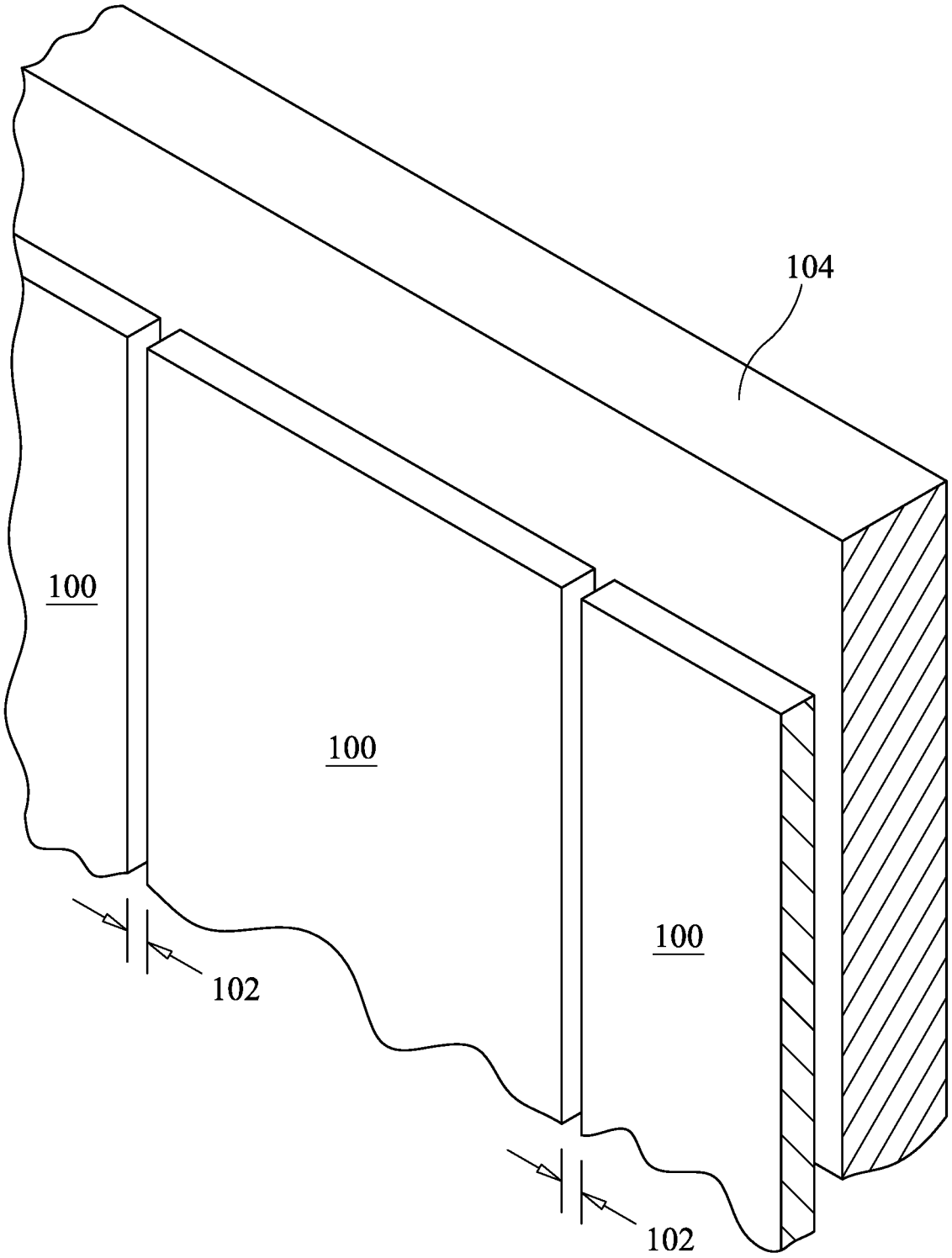
FIG. 1 is a perspective view of a wall of a building with three composite building panels attached thereto.
Figure 2:
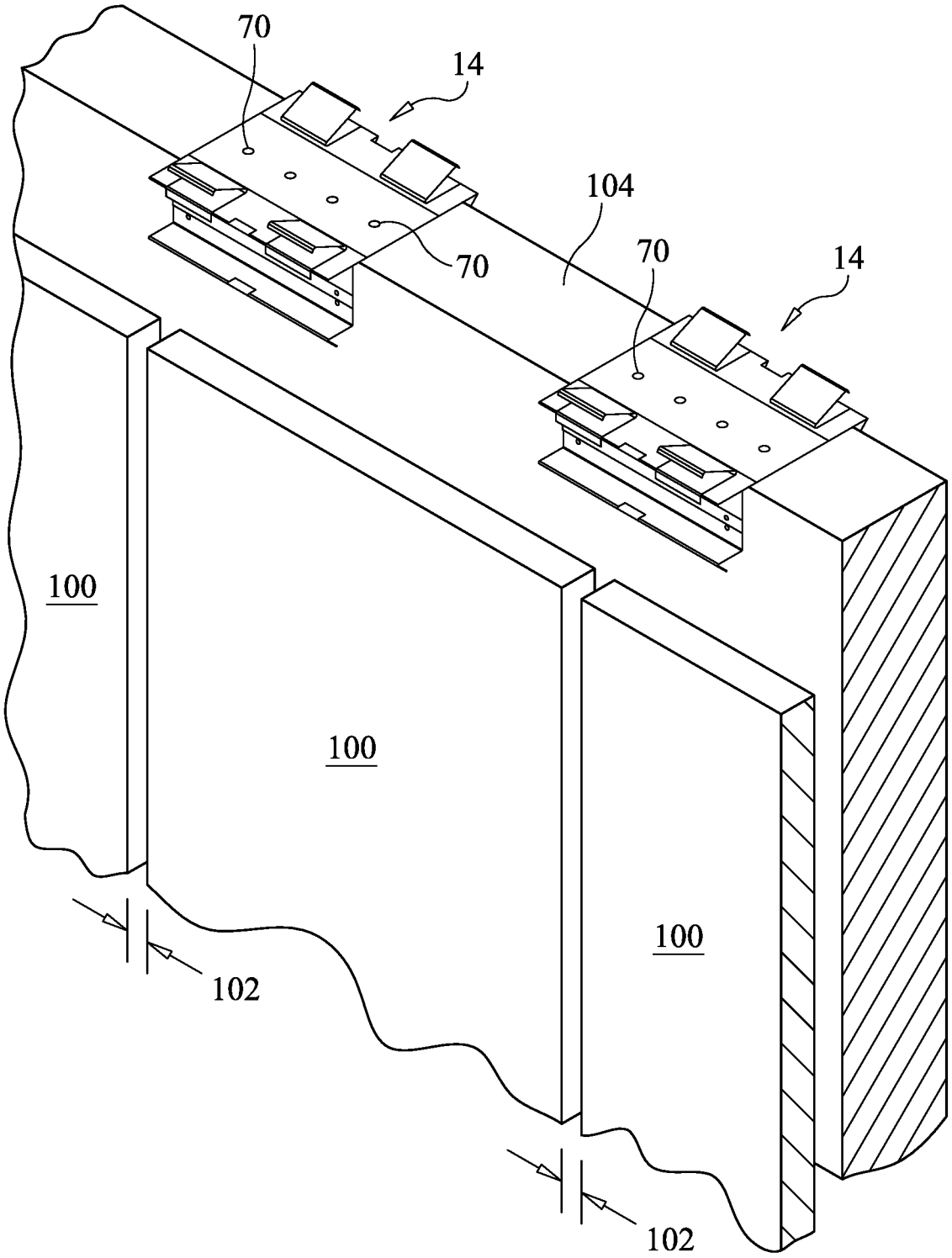
FIG. 2 is a perspective view of a wall of a building with three composite building panels and two spring support clips attached to a top of the wall of a panel coping system in accordance with the present invention.
Figure 3:
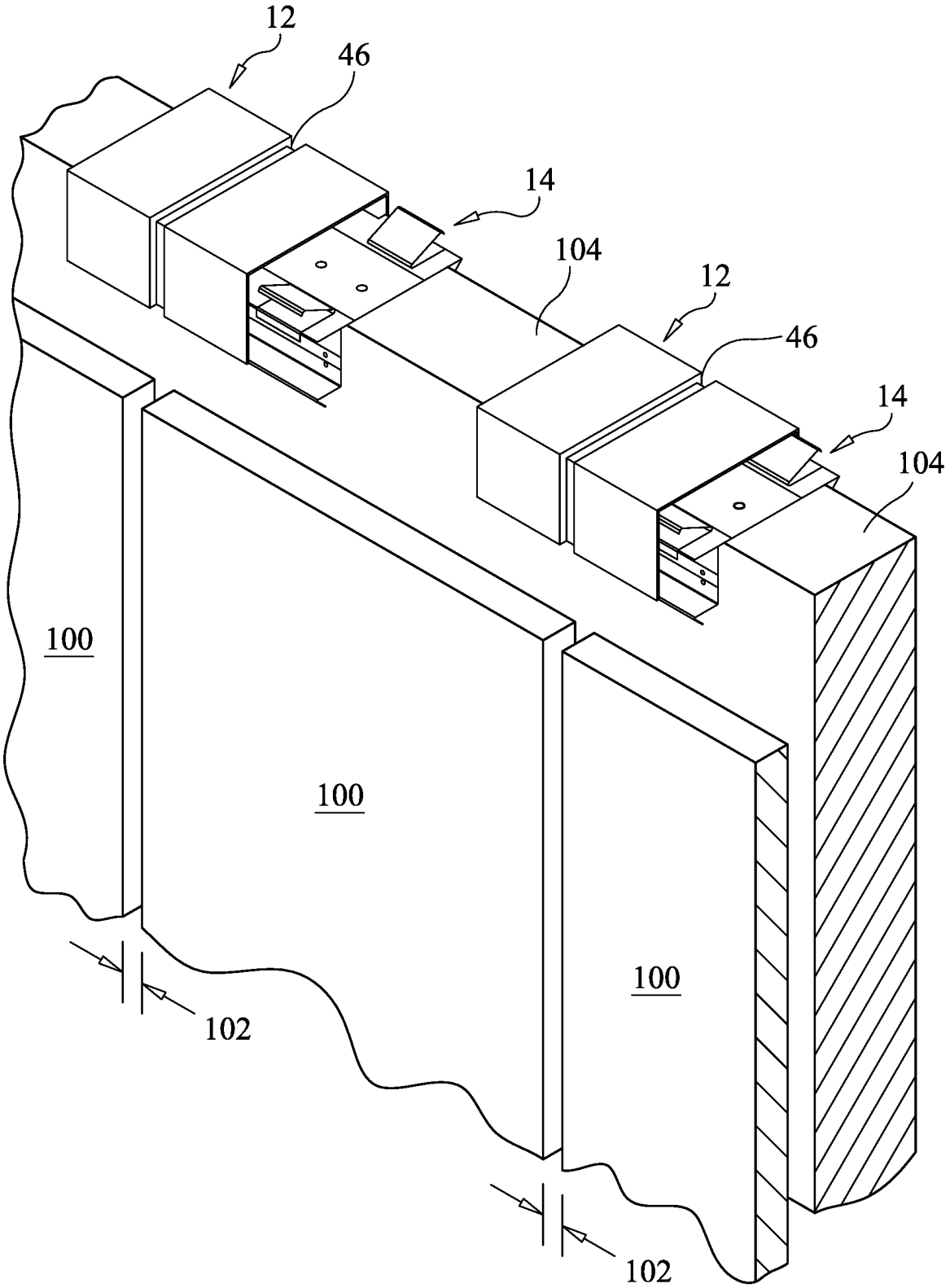
FIG. 3 is a perspective view of a wall of a building with three composite building panels, two spring support clips attached to a top of the wall and two coping splices placed on the two spring support clips of a panel coping system in accordance with the present invention.
Figure 4:
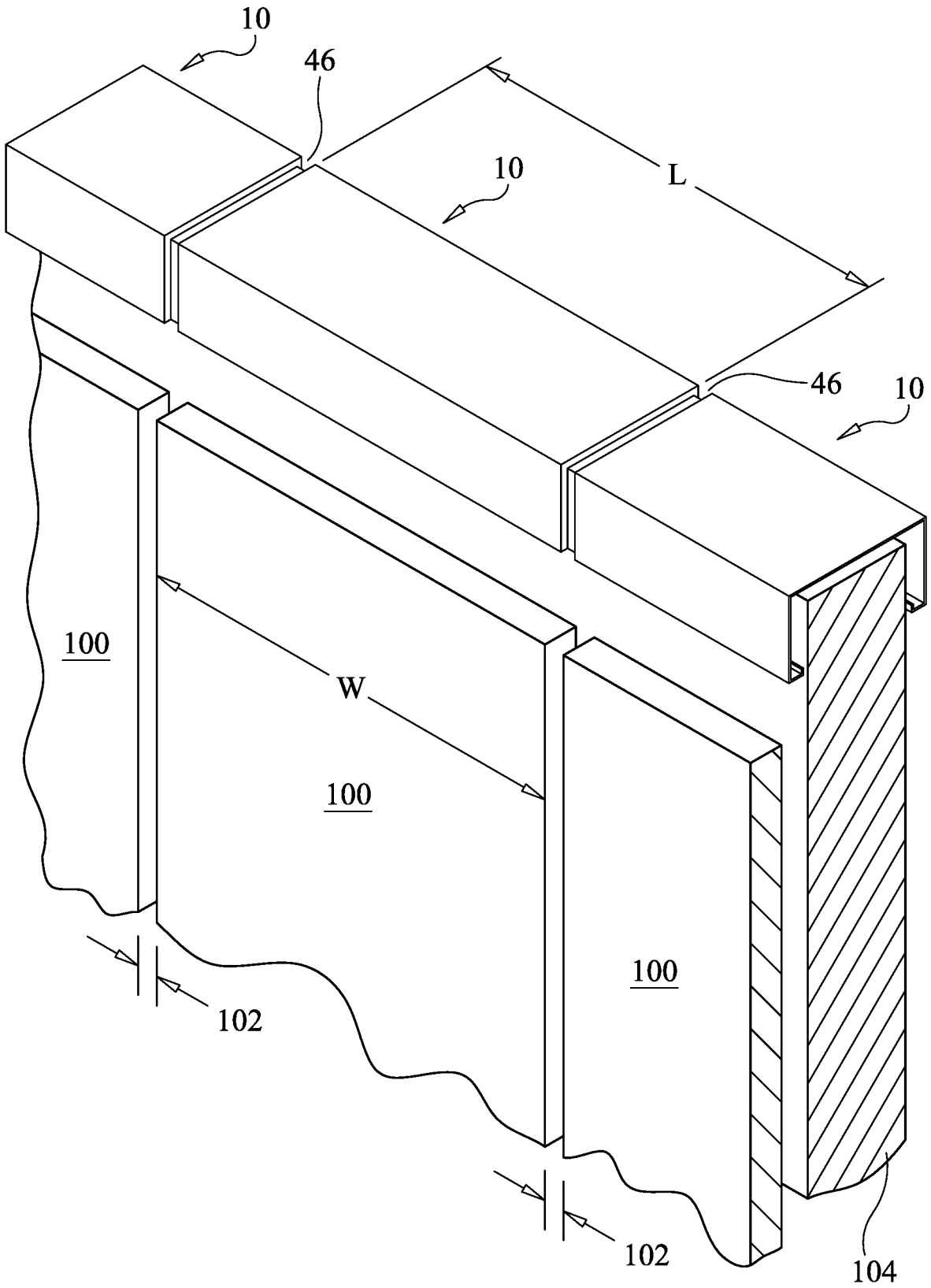
FIG. 4 is a perspective view of a wall of a building with three composite building panels, two spring support clips attached to a top of the wall, two coping splices placed on the two spring support clips and three coping covers attached over the two coping splices and to the two spring support clips of a panel coping system in accordance with the present invention.
Figure 5:
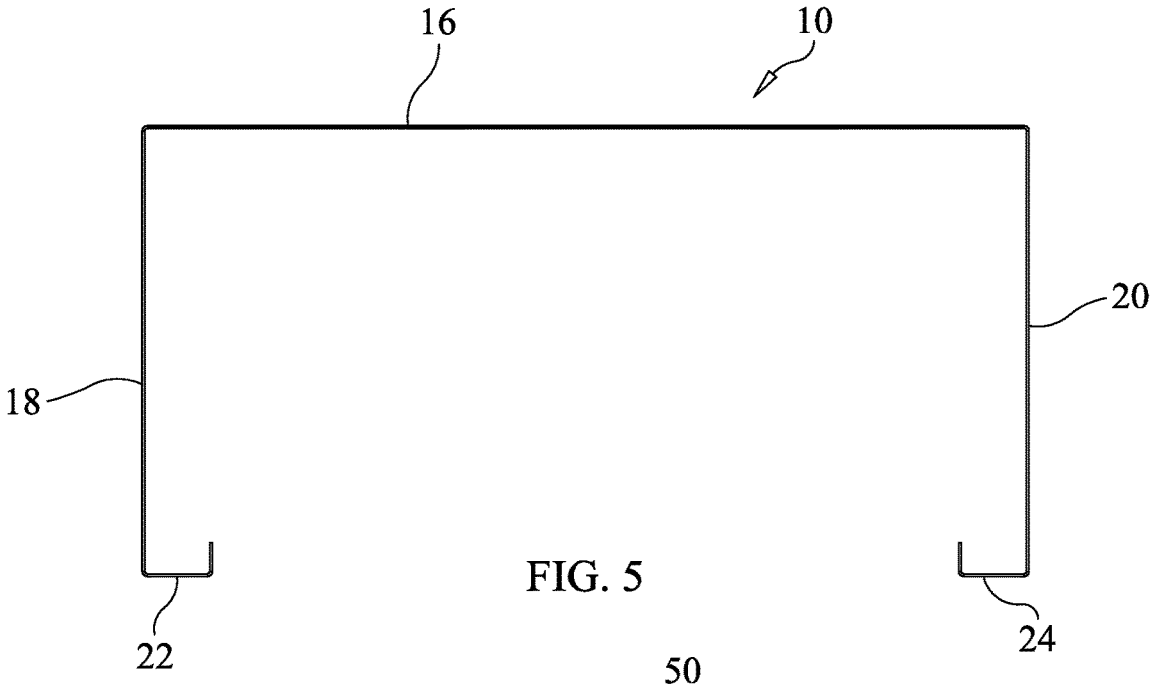
FIG. 5 is an end view of a coping cover of a panel coping system in accordance with the present invention.
Figure 8:
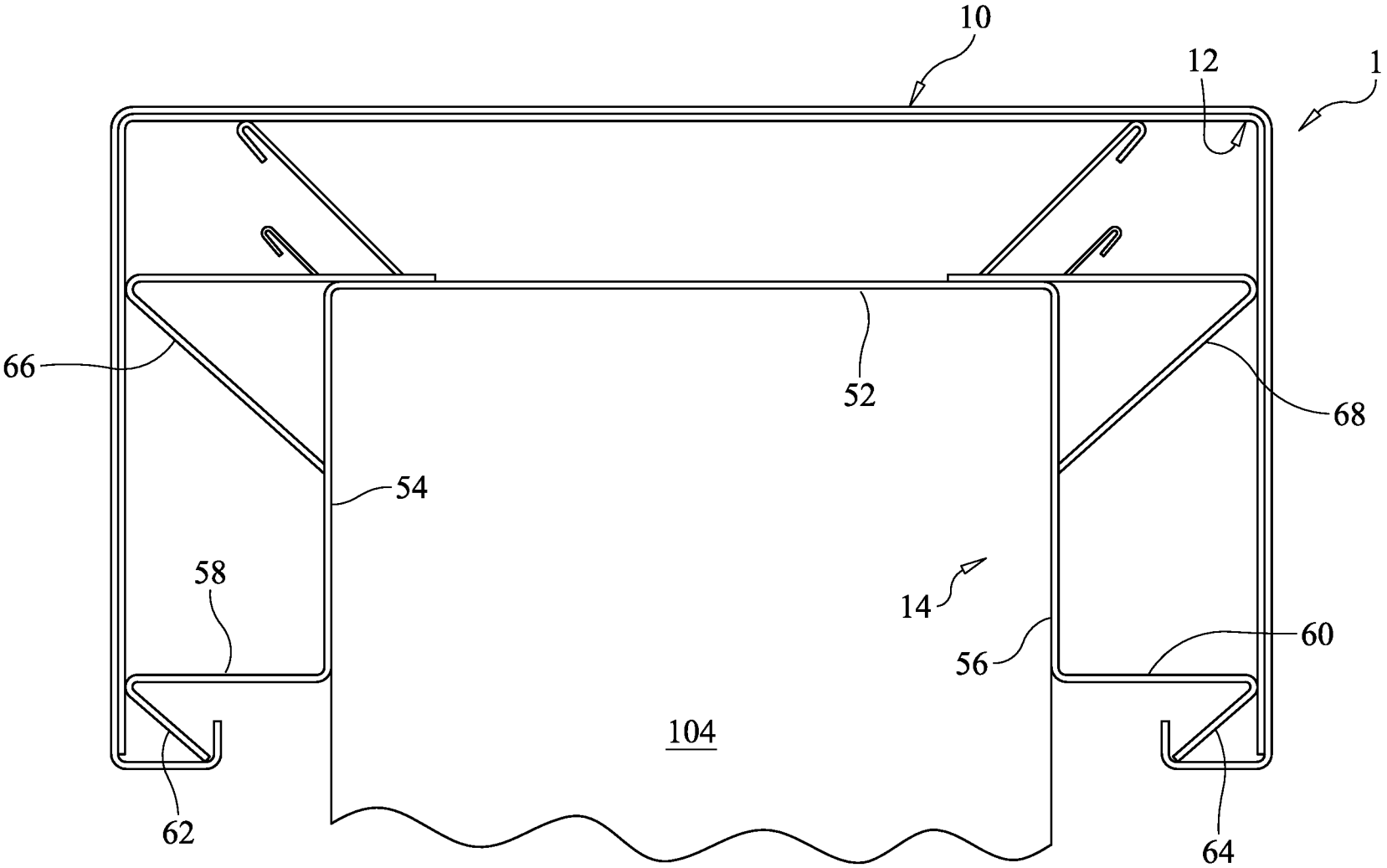
FIG. 8 is an end view of panel coping system mounted to a top of a wall of a building in accordance with the present invention.

With reference now to the drawings, and particularly to FIG. 8, there is shown an end view of a panel coping system 1. The panel coping system preferably includes a plurality of coping covers 10, a plurality of coping splices 12 and a plurality of spring support clips 14. With reference to FIG. 5, each coping cover 10 preferably includes a top member 16, a first side member 18, a second side member 20, a first hook member 22 and a second hook member 24. The first side member 18 extends downward from a first end of the top member 16 and the second side member 18 extends downward from a second end of the top member 16. A bottom of the first side member 18 is terminated with the first hook member 22. A bottom of the second side member 20 is terminated with the second hook 24.

Figure 7:
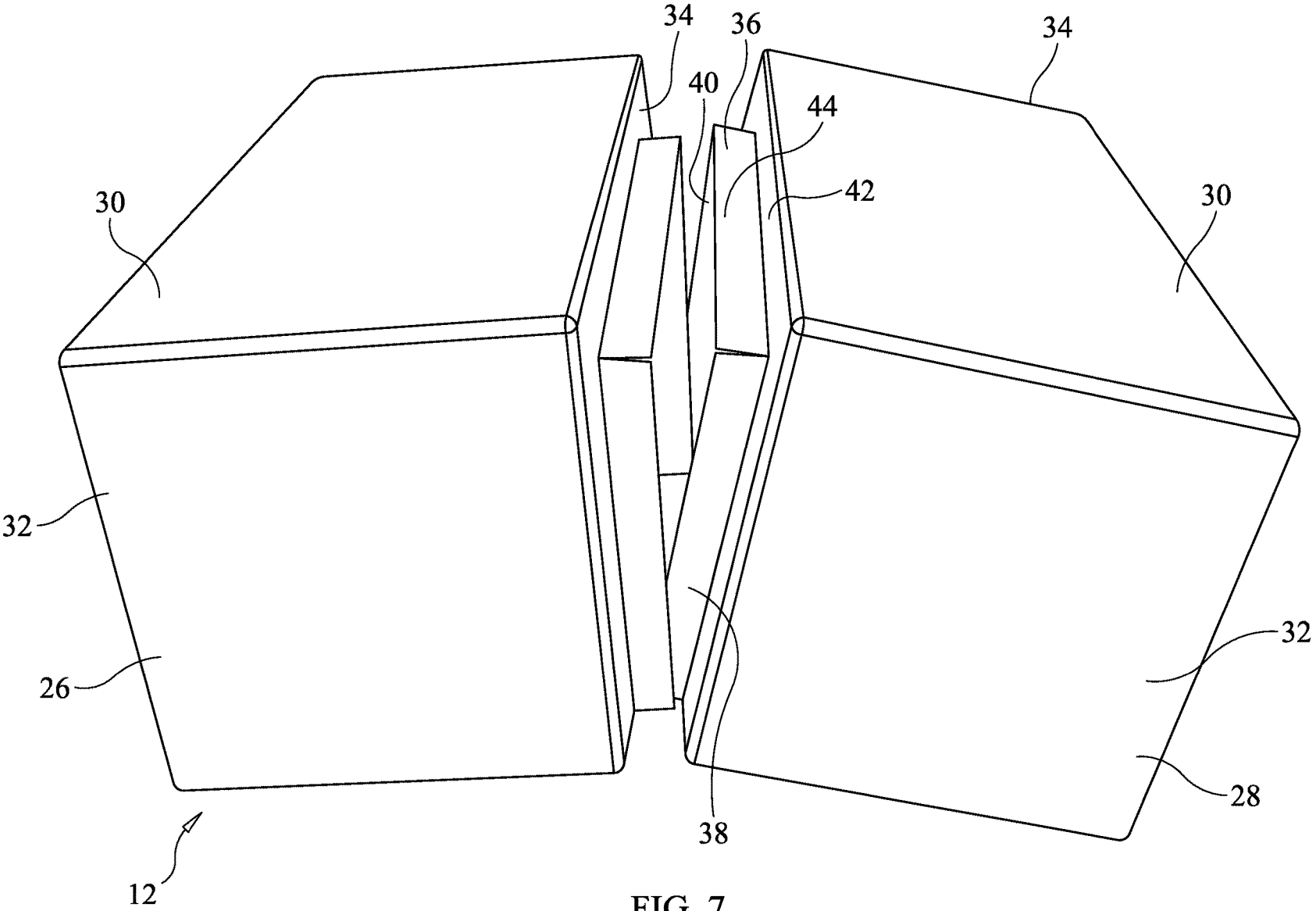
FIG. 7 is an exploded perspective view of a coping splice of a panel coping system in accordance with the present invention.

With reference to FIG. 7, each coping splice preferably includes a first splice section 26 and a second splice section 28. The first splice section 26 is preferably the same as the second splice section 28. Each splice section 26, 28 includes a top coping member 30, a first coping side member 32 and a second coping side member 34. The first coping side member 32 extends downward from a first end of the top coping member 30. The second coping side member 34 extends downward from a second end of the top coping member 30. A top offset portion 36 extends from one end of the top coping member 30. A first offset portion 38 extends from one end of the first coping side member 32. A second offset portion 40 extends from one end of the second coping member 34.

Each offset portion 36, 38, 40 includes an end portion 42 and a flange portion 44. The end portion 42 extends downward from an end of the coping member 36, 38, 40. The flange portion 44 extends outward from a bottom of the end portion 42. The first splice section 26 is assembled to the second splice section 28 by applying a bonding substance to an outer surface area of the first flange portions 44 of the first splice section 26; applying a bonding substance to an inner surface of the second flange portions 44 of the second splice section 28; and inserting the first flange portions 44 of the first splice section 26 into the second flange portions 44 of the second splice section 28. The first and second offset portions 36, 38, 40 of the first and second splice sections 26, 28 form a panel channel 46. A width of the panel channel is the same as a spacing 102 between two adjacent building panels 100.

Figure 6:
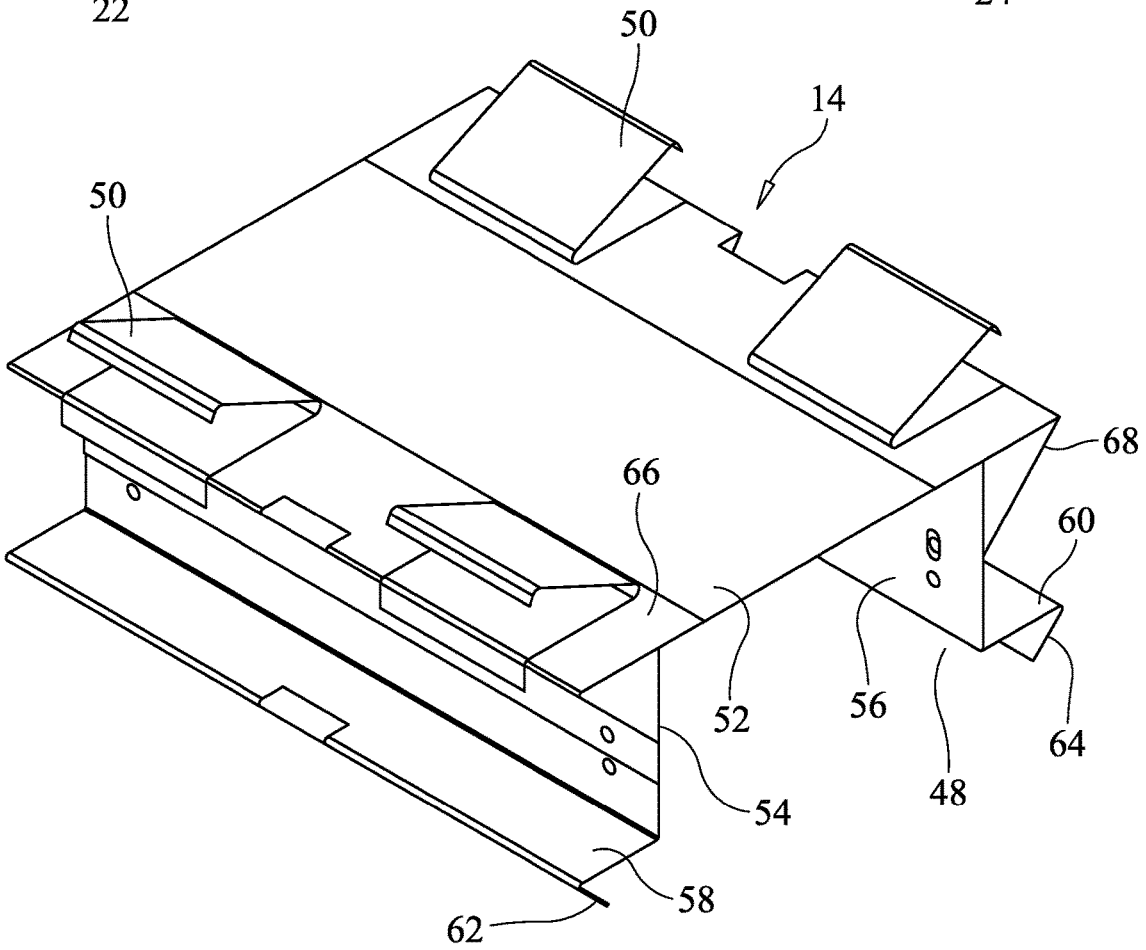
FIG. 6 is a perspective view of a spring support clip of a panel coping system in accordance with the present invention.

With reference to FIGS. 6 and 8, each spring support clip 14 preferably includes a base portion 48 and a plurality of spring clips 50. The base portion 48 may be fabricated from a single piece of material or multiple pieces of material. The base portion 48 preferably includes a top clip member 52, a first clip side member 54, a second clip side member 56, a first flange member 58, a second flange member 60, a first retention clip 62 and a second retention clip 64. The plurality of spring clips 50 are attached to a top of the top clip member 52 with any suitable fastening device or method. The first clip side member 54 extends downward from a first end of the top clip member 52 and the second clip side member 56 extends downward from a second end of the top clip member 52. A first support projection 66 preferably extends outward from the first clip side member 54 to support the first side member 18 of the coping cover 10. A second support projection 68 preferably extends outward from the second clip side member 56 to support the second side member 20 of the coping cover 10. The first flange member 58 extends outward from a bottom of the first clip side member 54. The second flange member 60 extends outward from a bottom of the second clip side member 56. An end of the first flange member 58 is terminated with the first retention clip 62. An end of the second flange member 60 is terminated with the second retention clip 64.

With reference to FIGS. 1-4, the panel coping system 1 is preferably assembled in the following manner. A plurality of spring support clips 14 are attached to the top of a parapet or building wall 104 with a plurality of fasteners 70 or the like. The spring support clip 14 must be located, such that thereof is close to, or over the panel spacing 102 between two adjacent building panels 100. The plurality of coping splices 12 are placed on the spring support clip 14, such that the panel channel 46 aligns with the panel spacing 102 between the two adjacent building panels 100. The coping cover 10 includes a length "L", which is the same as the width "W" of the building panel 104. One end of the coping cover 10 is placed over a first coping splice 12 and snapped to a first spring support clip 14, and an opposing end of the coping cover 10 is placed over a second coping splice 12 and snapped to a second spring support clip 14. The first retention clip 62 of the spring support clip 14 retains the first hook member 22 of the coping cover 10. The second retention clip 64 of the spring support clip 14 retains the second hook member 24 of the coping cover 10.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A matching coping system for building panels, comprising:

a coping cover includes a top member, a first side member, a second side member, a first hook member and a second hook member, said first hook member terminates a bottom of said first side member, said second hook member terminates a bottom of said second side member;

a coping splice includes a top coping member, a first coping side member and a second coping side member, a panel channel is formed in said top coping member, said first coping side member and said second coping side member;

a spring support clip includes a base portion and a plurality of spring clips, said base portion includes a top clip member, a first clip side member, a second clip side member, a first retention clip and a second retention clip, said first retention clip extends from a bottom of said first clip side member, said second retention clip extends from a bottom of said second clip side member, wherein said coping splice is placed over said spring support clip, one end of said coping cover is placed over said coping splice, said first and second hook members of said coping cover are snapped over said first and second retention clips of said spring support clip, wherein said plurality of spring clips are attached to a top of said top clip member; and further comprising:

a first support projection extends outward from said first clip side member, a second support projection extends outward from said second clip side member.

2. The matching coping system for building panels of claim 1, wherein:

said first side member extends downward from a first end of said top member, said second side member extends downward from a second end of said top member.

3. The matching coping system for building panels of claim 1, wherein:

said first coping side member extends downward from a first end of said top coping member, said second coping side member extends downward from a second end of said top coping member.

4. The matching coping system for building panels of claim 1, wherein:

said first clip side member extends downward from a first end of said top clip member, said second clip side member extends downward from a second end of said top clip member.

5. A matching coping system for building panels, comprising:

a coping cover includes a top member, a first side member, a second side member, a first hook member and a second hook member, said first hook member terminates a bottom of said first side member, said second hook member terminates a bottom of said second side member;

a coping splice includes a top coping member, a first coping side member and a second coping side member, a panel channel is formed in said top coping member, said first coping side member and said second coping side member; and a spring support clip includes a base portion and a plurality of spring clips, said base portion includes a top clip member, a first clip side member, a second clip side member, a first flange member, a second flange member, a first retention clip and a second retention clip, said first flange member extends outward from a bottom of said first clip side member, said second flange member extends outward from a bottom of said second clip side member, said first retention clip terminates an end of said first flange member, said second retention clip terminates an end of said second flange member, wherein said base portion is secured to a top of a wall, said coping splice is placed over said spring support clip, one end of said coping cover is placed over said coping splice, said first and second hook members of said coping cover are snapped over said first and second retention clips of said spring support clip; and further comprising:

a first support projection extends outward from said first clip side member, a second support projection extends outward from said second clip side member.

6. The matching coping system for building panels of claim 5, wherein:

said first side member extends downward from a first end of said top member, said second side member extends downward from a second end of said top member.

7. The matching coping system for building panels of claim 5, wherein:

said first coping side member extends downward from a first end of said top coping member, said second coping side member extends downward from a second end of said top coping member.

8. The matching coping system for building panels of claim 5, wherein:

said first clip side member extends downward from a first end of said top clip member, said second clip side member extends downward from a second end of said top clip member.

9. The matching coping system for building panels of claim 5, wherein:

said plurality of spring clips are attached to a top of said top clip member.

10. A matching coping system for building panels, comprising:

a coping cover includes a top member, a first side member, a second side member, a first hook member and a second hook member, said first hook member terminates a bottom of said first side member, said second hook member terminates a bottom of said second side member;

a coping splice includes a first splice section and a second splice section, each said splice section includes a top coping member, a first coping side member and a second coping side member, a first offset portion extends from one end of said first splice section, a second offset portion extends from one end of the second splice section, said first offset portion is attached to said second offset portion to form a panel channel; and a spring support clip includes a base portion and a plurality of spring clips, said base portion includes a top clip member, a first clip side member, a second clip side member, a first retention clip and a second retention clip, said first retention clip extends from a bottom of said first clip side member, said second retention clip extends from a bottom of said second clip side member, wherein said coping splice is placed over said spring support clip, one end of said coping cover is placed over said coping splice, said first and second hook members of said coping cover are snapped over said first and second retention clips of said spring support clip; and further comprising:

a first support projection extends outward from said first clip side member, a second support projection extends outward from said second clip side member.

11. The matching coping system for building panels of claim 10, wherein:

said first side member extends downward from a first end of said top member, said second side member extends downward from a second end of said top member.

12. The matching coping system for building panels of claim 10, wherein:

said first coping side member extends downward from a first end of said top coping member, said second coping side member extends downward from a second end of said top coping member.

13. The matching coping system for building panels of claim 10, wherein:

said first clip side member extends downward from a first end of said top clip member, said second clip side member extends downward from a second end of said top clip member.

14. The matching coping system for building panels of claim 10, wherein:

said plurality of support clips are attached to a top of said top clip member.

15. The matching coping system for building panels of claim 10, wherein:

said first and second offset portions each include an end portion and a flange portion, said end portion extends downward from an end of said top coping member, said first coping side member and said second coping side member, said flange portion extends outward from a bottom of said end portion.

16. The matching coping system for building panels of claim 15, wherein:

said flange portion of said first splice section is attached to said flange portion of said second splice section with a bonding substance.

* * * * *